US005972265A

United States Patent [19]

Marra et al.

[11] Patent Number: 5,972,265

[45] Date of Patent: Oct. 26, 1999

[54] METHOD AND APPARATUS FOR PRODUCING COMPOSITES

[75] Inventors: Alan A. Marra, Amherst, Mass.; Robert Marra, Brookings, Oreg.

[73] Assignee: Forest Products Development Laboratories, Inc. L.L.C., Amherst, Mass.

[21] Appl. No.: 09/082,846

[22] Filed: May 21, 1998

[51] Int. Cl.[6] ..... B27N 3/02

[52] U.S. Cl. ..... 264/112; 264/118; 264/121; 425/81.1; 425/82.1; 425/83.1

[58] Field of Search ..... 264/112, 116, 264/121; 425/81.1, 82.1, 83.1

[56] References Cited

U.S. PATENT DOCUMENTS

| | | | |
|---|---|---|---|
| 1,931,570 | 10/1933 | Brown et al. . | |
| 2,067,251 | 1/1937 | Taylor . | |
| 2,736,362 | 2/1956 | Slayter et al. . | |
| 3,096,227 | 7/1963 | Van Elten | 156/372 |
| 3,256,208 | 6/1966 | Knox . | |
| 3,308,218 | 3/1967 | Wiegand et al. | 264/121 |
| 3,346,682 | 10/1967 | Thomson . | |
| 3,557,263 | 1/1971 | Marra | 264/45 |
| 3,671,377 | 6/1972 | Marra . | |
| 4,097,965 | 7/1978 | Gotchel et al. | 19/306 |
| 4,172,056 | 10/1979 | Marra . | |
| 4,255,108 | 3/1981 | Bleymaier et al. | 425/174.8 |
| 4,701,294 | 10/1987 | Radwanski et al. | 264/518 |
| 4,865,788 | 9/1989 | Davis | 264/112 |
| 4,927,582 | 5/1990 | Bryson | 264/113 |
| 4,973,440 | 11/1990 | Tamura et al. | 264/114 |
| 5,102,595 | 4/1992 | Tilby | 264/113 |
| 5,108,678 | 4/1992 | Hirasaka et al. | 264/113 |
| 5,114,631 | 5/1992 | Nyssen et al. | 264/6 |
| 5,229,051 | 7/1993 | Billiu | 264/115 |

*Primary Examiner*—Mary Lynn Theisen
*Attorney, Agent, or Firm*—Mary M. Moyne; Ian C. McLeod

[57] ABSTRACT

A method and system (10) for producing a composite material (108) from particles (102) and binder (104), is described. The system includes a feed zone (12), a unilayering zone (14), a mat reforming zone (16) and a compaction zone (18) all closely coupled to reduce time and allow the use of fast setting binders. A preformed feed mat (100) is fed into the spike wheels (22 and 24) of the feed zone. The spike wheels extract particles from the premat and impinge the particles onto an oscillating shield (26) in the layering zone. The oscillating shield moves across the thickness of the mat-forming zone depositing the particles uniformly on the trailing edge of the reformed mat (106) at the top (48A) of the tunnel conveyor (48) of the mat reforming zone. As the particles move past the lower end (26B) of the shield a binder is added to the particles. Overlays or release films (50) are introduced at the top of both sides of the tunnel conveyor so as to engage the surfaces of the reformed mat. When the reformed mat of particles and binder exits from the bottom (48B) of the tunnel conveyor, the mat immediately enters the converging conveyors (54 and 56) of the compaction zone. The converging conveyors compact the mat to the final thickness of the composite material.

18 Claims, 6 Drawing Sheets

METHOD AND APPARATUS FOR PRODUCING COMPOSITES

BACKGROUND OF THE INVENTION (1) Field of the Invention

The present invention relates to a method and system for making composite materials. In particular, the present invention relates to a method and system for making composite materials using wood particles and a binder. The method and system allows for controlled, simultaneous feeding of the particles and binder to form a uniform mat. The system and method also provides for compaction of the mat immediately after formation of the mat prior to setting of the binder.

(2) Description of the Related Art

The related art has shown various types of apparatuses and methods for making composite panels from particles. In general these processes provide means for mixing binder with particles, producing a uniform mat with this furnish, and then consolidating it with pressure. Many processes also combine heat with pressure not only to cure the binder but also to make the particles more compliant to compression. The related art thus contains different means for mixing ingredients, forming into mats, and applying pressure, with or without introducing heat. Illustrative are U.S. Pat. No. 2,854,372 to Yan et al; U.S. Pat. No. 3,256,215 to Knox; U.S. Pat. No. 3,308,218 to Wiegand et al; U.S. Pat. No. 4,097,965 to Gotchel et al; U.S. Pat. No. 4,255,108 to Bleymaier et al; U.S. Pat. No. 4,701,294 to Radwanski et al; U.S. Pat. No. 4,865,788 to Davis; U.S. Pat. No. 5,102,595 to Tilby; and U.S. Pat. No. 5,108,678 to Hirasaka et al.

Yan et al describe a method of forming a board with elongate particulates which are deposed essentially parallel to the surfaces and one edge of a panel. The method involves edge-forming as opposed to conventional flat-forming. Particles previously coated with binder, are dropped into a hopper fitted with baffles that disperse the particles as they fall between two moving endless parallel steel bands spaced apart vertically. Thus confined, the elongate particles are forced to orient themselves essentially parallel to the surfaces of the belts as well as parallel to the continuously forming edge of the mat. The mat is then conveyed into a hot press for consolidation with pressure in the face direction.

Knox shows a process for incorporating finely ground fillers to a polyurethane froth by comixing during formation of the froth. Alternatively, for coarser fillers, a froth is added as a layer to the top of a preformed mat of the filler and driven in by platen or mold pressure.

Wiegand et al describe an air-lay system for forming a fibrous mat in which a tackifying material is added to prevent intermeshing and thereby produce a low density mat for later consolidation by normal means.

Gotchel et al describe an apparatus and method for dry-forming fibrous structures by a system of drums with projections that individualize fibers from a laminate feed and blends different length fibers into a uniform mat using air flow to control the passage of fibers.

Bleymaier et al in eliminating the use of pneumatic transport and felting, utilize a system of brush rolls to distribute finely comminuted fiber into a mat suitable for later alignment by electric field means into a final mat for consolidating into fiberboard with directional properties.

Radwanski et al describe an apparatus and method for individualizing fibers from a fiberizable feed material and forming a pad of varying cross sections for use where absorbent materials are needed. The apparatus includes a drum surfaced with projections that disintegrate the feed material into fibers which are air entrained and blown into a forming zone with a compressed gas where other baffle-controlled gas streams direct the fibers to selected areas on a moving foraminous web, below which is a suction box to remove air from the system.

Davis describes a system of picker rolls to break up and meter bales of different types of fiber to form separate but superposed layers composed of different fibers which are then fed through blender rolls to thoroughly mix them. It is reformed into a mat with the aid of spike wheels and air pressure, given a dusting of a powdered binder and reblended through another set of picker rolls. Reformed again with spike wheels and air pressure, the mat then is overlayed with a non-woven scrim which is needled into the mat to improve properties of the product and to impart temporary integrity for handling into molds.

Tilby describes an apparatus and method for composing a mat of relatively long, straight strands such as rind strands from sugar cane processing which is comprised of a feed conveyor moving the long strands, already dried and coated with binder, to a drop zone over a pair of counter rotating rolls fitted with flicker tines which fling the strands randomly and uniformly over a moving conveyor below, ready for consolidation by conventional pressing.

Also of interest are U.S. Pat. Nos. 3,557,263, 3,671,377 and 4,172,056 all to Marra. '263 and '377 relate to a rigid composite product and to the process for preparation thereof. The process for preparing the composite product involves adding a foam precursor to a loosely formed mat of fibrous strands and allowing the expanding foam to disperse itself throughout the mat and upon curing without the introduction of heat, consolidate the product. '056 describes products of wood and resinated cement in which the components are wet-mixed mechanically and charged batch-wise to a mold for forming to a product.

Only of minimal interest are U.S. Pat. No. 1,931,570 to Brown et al; U.S. Pat. No. 2,067,251 to Taylor; U.S. Pat. No. 2,736,362 to Slayter et al; U.S. Pat. No. 3,096,227 to Van Elten; U.S. Pat. No. 3,346,682 to Thomson and U.S. Pat. No. 5,114,631 to Nyssen et al.

Brown et al show a means of forming panels with excelsior and a cementitious binder in which the long strands are first reduced in length, gathered into a fluffy mat by spike wheels and air pressure, gradually compressed between roll-backed belts, flooded with excess binder which is squeezed out by opposed rollers, cut to length, and stacked in a batch press under pressure until the binder sets.

Taylor shows a method of extruding molten plastic through nozzles to produce fibers which are then collected loosely on a rotating drum for later spinning into yarn.

Slayter et al shows a method of making fiberglass insulating mats by first producing mineral fibers and forming them directly into a veil by feeding them between cooperating rollers. The veil is diffused with powdered binder blown in and vibrated to improve distribution and then folded on itself to produce a continuous batt. The later heating operation cures the binder.

Thomson shows a method of making a cigarette filtering medium by first extruding very fine plastic filaments and then forming them with roller pressure into a tape which is later expanded to a bulky material for fashioning into a filter.

Nyssen et al describe a process for making non-woven fabrics by spinning molten polymer under supply pressure radially from a plurality of openings mounted on a rotating nozzle head. A hot gas stream aids in propelling the spun fibers onto a circulating, air-permeable carrier.

The above representative review of related art describes various ways of forming composites from fibrous particles. There remains a need for a method and system for producing composite materials comprised of particles which allows for the simultaneous deposition of particle and binder into a mat so that immediate consolidation can occur without further manipulation, thus permitting the use of fast, selfcuring binders to achieve a more versatile and more efficient processing system in which an oscillating shield is used to create a unilayer stream of particles for easy coating with binder and for uniform distribution of furnish in the forming zone.

Further, there remains a need for an apparatus and method for forming composites from fibrous particles which, in conjunction with co-pending applications relating to the production of fibrous strands from waste or unwanted wood, would allow small businesses to utilize such unused resources, scattered and essentially worthless "as is, where is", thus contributing to a local economy while promoting environmentally favorable practices.

OBJECTS

It is therefore an object of the present invention to provide a system which uses a preformed mat to regulate the feed of particles to the system and consequently, the amount of particles in the composite material produced by the system. Further, it is an object of the present invention to provide a system for producing a composite material which uses an oscillating, vertical shield or plate to orientate the particles predominately in the plane of the shield or plate and to form them into a uniform layer prior to application of the binder. Still further, it is an object of the present invention to provide a system which allows for the use of fast-setting binders in the production of a composite material. Further still, it is an object of the present invention to provide a method for manufacturing composite materials which utilizes a means for incorporating fast-setting binders with particles and depositing the particles with the binders in a controlled manner to form a mat for immediate consolidation into the composite material without further manipulation. Further, it is an object of the present invention to provide a method of manufacturing a composite material which allows the use of a variety of particle materials and binders. It is further an object of the present invention to provide a simple, low cost and versatile system for manufacturing composite materials having a variety of compositions, densities, thicknesses, and configurations. These and other objects will become increasingly apparent by reference to the following drawings and the description.

DETAILED DESCRIPTION OF THE PREFERRED EMBODIMENTS

Figure 1:
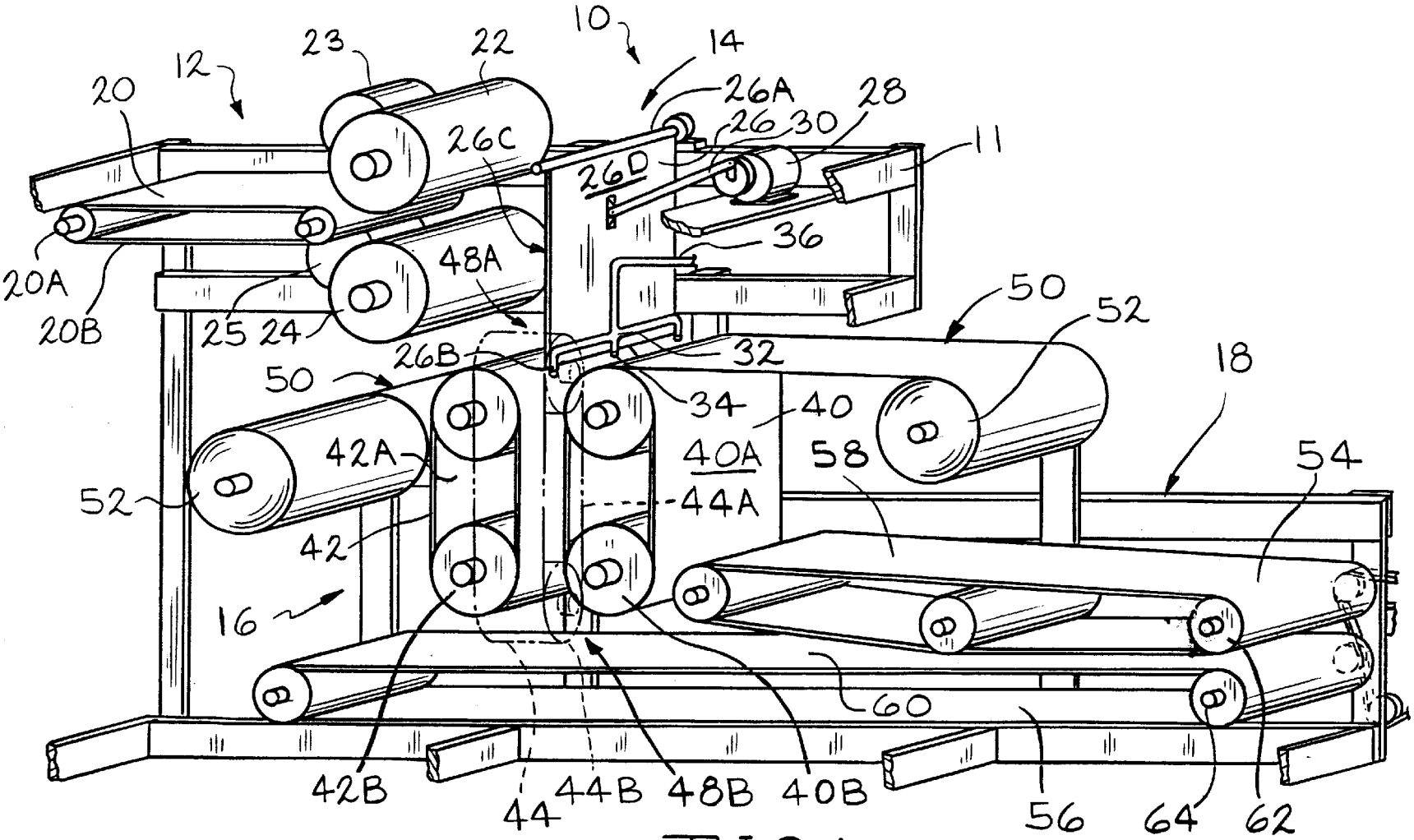
FIG. 1 is a front perspective view of the system 10 of the present invention.

The present invention relates to a system for forming a composite material of discontinuous particles bound with a binder by introducing the binder onto the particles, the improvement which comprises: a vertically oriented plate with opposed first and second ends and having opposed faces which is pivoted at the first end and mounted on a frame; a supply means for the binder having an opening and mounted adjacent the second end of the plate so as to feed the binder to the particles; a moving means mounted on the frame means for oscillating the plate; a feed means for impacting the particles against one of the faces of the plate so that the particles flow toward the second end of the plate as a layer which is then provided with the binder from the supply means; and a conveyor means for forming the layer of particles with the binder into a mat, for conveying the mat away from the second end of the plate and for forming the composite material.

Further, the present invention relates to a method for forming a composite material of discontinuous particles bound with a binder by introducing a binder onto the particles, which comprises the steps of: providing a system having a vertically oriented plate with opposed first and second ends and opposed faces which is pivotably mounted at the first end on a frame; supply means for the binder having an opening and mounted adjacent the second end of the plate; oscillating means mounted on the frame for pivoting the plate; feed means for impacting the particles against one of the faces of the plate; and conveyor means for forming the layer of particles with the binder into a mat, for conveying the layer of the particles with the binder away from the second end of the plate and for forming the composite material; introducing the particles into the feed means; propelling the particles from the feed means toward the plate; impinging the particles on one face of the plate; oscillating the plate so that the particles form a layer and move toward the second end of the plate; applying from the opening in the supply means, the binder to the layer of particles adjacent the second end of the plate; and moving the layer with the binder through the conveyor means.

Although the compositing system described herein can accept many types of comminuted material, it is especially adapted to a "fibrous strand" which because of its three-dimensional nature lends itself to the controlled manipulation and deposition of the system. In the lexicon of the smaller wood elements derivable from wood, the terms flake, strand, splinter, sliver, fiber bundle and fiber are associated with definite products into which they are composed. Each element contributes characteristics to the composite and to its processing in accordance with the element's geometry. The fibrous strand is a combination element being composed of both a strand-like element and fiber-like elements. The strand part may be straight but is usually bent or curved. The fibrous parts are partially cleaved appendages that branch off in random directions. U.S. Pat. No. 3,671,377 to Marra describes one type of fibrous strand.

Fibrous strands, like other wood elements, can be produced and have utility over a rather wide range of sizes. Fibrous strands are three-dimensional particles (3-DP), compared to two-dimensional flakes, and one-dimensional slivers or splinters. Strands (actually narrow flakes) as used in Oriented Strand Boards (OSB), are, strictly speaking, two-dimensional but are used in a one-dimensional manner (oriented) to create strength in a given direction.

The three-dimensional configuration of the fibrous strand contributes uniquely to its further processing and to the properties of the resulting composite material. Unlike flakes and other linear or flat elements that depose themselves parallel to the surface upon which they fall, fibrous strands assume a more random orientation. Thus, flakes contribute strength primarily in the x-y plane, leaving the z plane relatively weak. Fibrous strands, however, because of their more random orientation, produce substantially greater strength in the z plane. The z plane figures heavily in the performance of overlays and in the general integrity of the composite material.

Fibrous strands also compose themselves into a rather open but cohesive mat. Such a mat is easily transported between operations, is easily infused with gases, liquids and powders, has less edge defects in pressing, produces strength perpendicular to faces, (high internal bond); and allows low, as well as high density composite materials to be made.

The three-dimensional configuration of fibrous strands confers versatility in consolidation to many types of products. Flat, molded or post-formed commodities or consumer products can be made, sometimes with the same composition. Properties are related to density which can range from about 8 pounds per cubic foot upward, depending upon the pressure applied during consolidation.

Fibrous strands can be produced by impact milling and by shredding directly from stove-wood size blocks. In the case of impact milling, it is necessary to have a means of extracting the fibrous strands from the milling zone as soon as the strands are formed in order to preserve their three-dimensional nature. Such a method is described in Applicant's co-pending application entitled: Controlled Impact Comminution of Wood. Concurrent removal also allows the milling of green wood which fiberizes better than dry wood, but tends to clog the grates of conventional hammermills and impact mills. This type of milling necessitates some prior preparation of the wood such as maxi-chipping, crushing, steaming or conditioning to appropriate moisture content.

In contrast, the shredding of stove-wood size blocks requires only chain-sawing to block size and perhaps some splitting to fit the feed opening. The block is held against an arrangement of teeth that are driven over the face of the wood in a manner that partly shears and partly tears out the fibrous strands. One such method and apparatus is described in Applicant's co-pending application entitled Wood Block Fiberizing Machine. Since the separating forces acting on the parent wood piece are more precisely controlled than in hammermilling, the resulting wood element has more uniformity and more precise dimensions. For the same reason, wood elements of similar configuration can be produced with different species, an advantage with variable resources.

Many different kinds of binders are compatible with the consolidation of fibrous strands. They include urethane, phenol, urea and resorcinol resins, soybean and casein, vinyl resins, polyester resins, elastomeric cements, lignin blends, starch, recycled plastics, hot melts, mineral cements and silicates. Each binder type contributes characteristics in properties, processing and costs. For example, elastomeric binders impart cushioning properties; starch, silicates and soybean offer low cost; mineral cements confer vermin and fire resistance as well as low cost; phenol and resorcinol resins produce ultimate durability and strength. One of the most versatile of the binders is foamed urethane due to its facile adhesiveness, fast room-temperature curing, ease of applying overlays and easy formability to solid or hollow shapes. The system 10 of the present invention, is designed for fast, room temperature setting binders 104 to eliminate the problems associated with driving heat into composite materials 108, especially thick ones. For this reason, the system 10 favors the production of thick materials.

Figure 2:
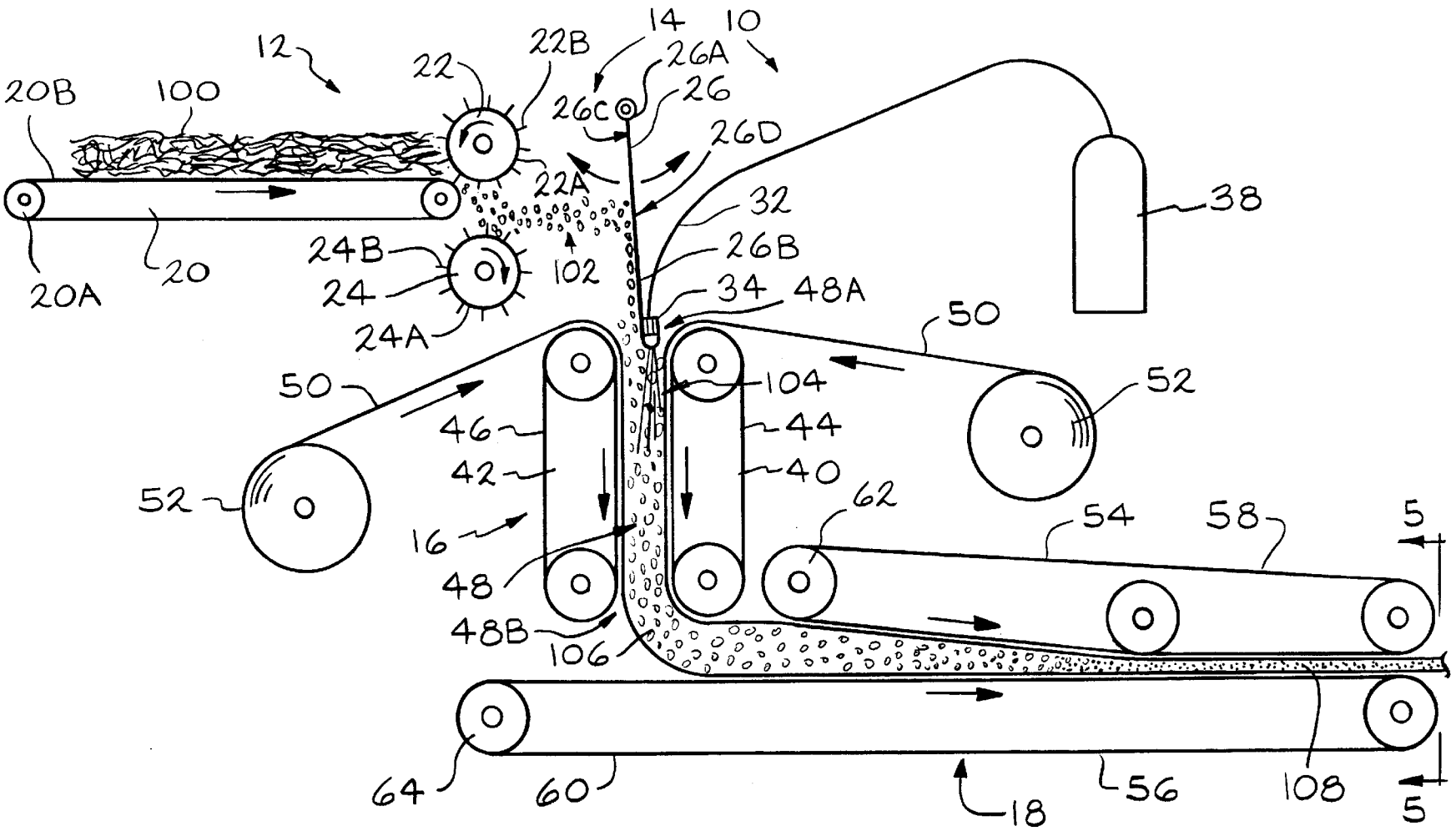
FIG. 2 is a front schematic view of the system 10 showing the flow of particles 102 and the formation of the mat 106 and the composite material 108.
Figure 3:
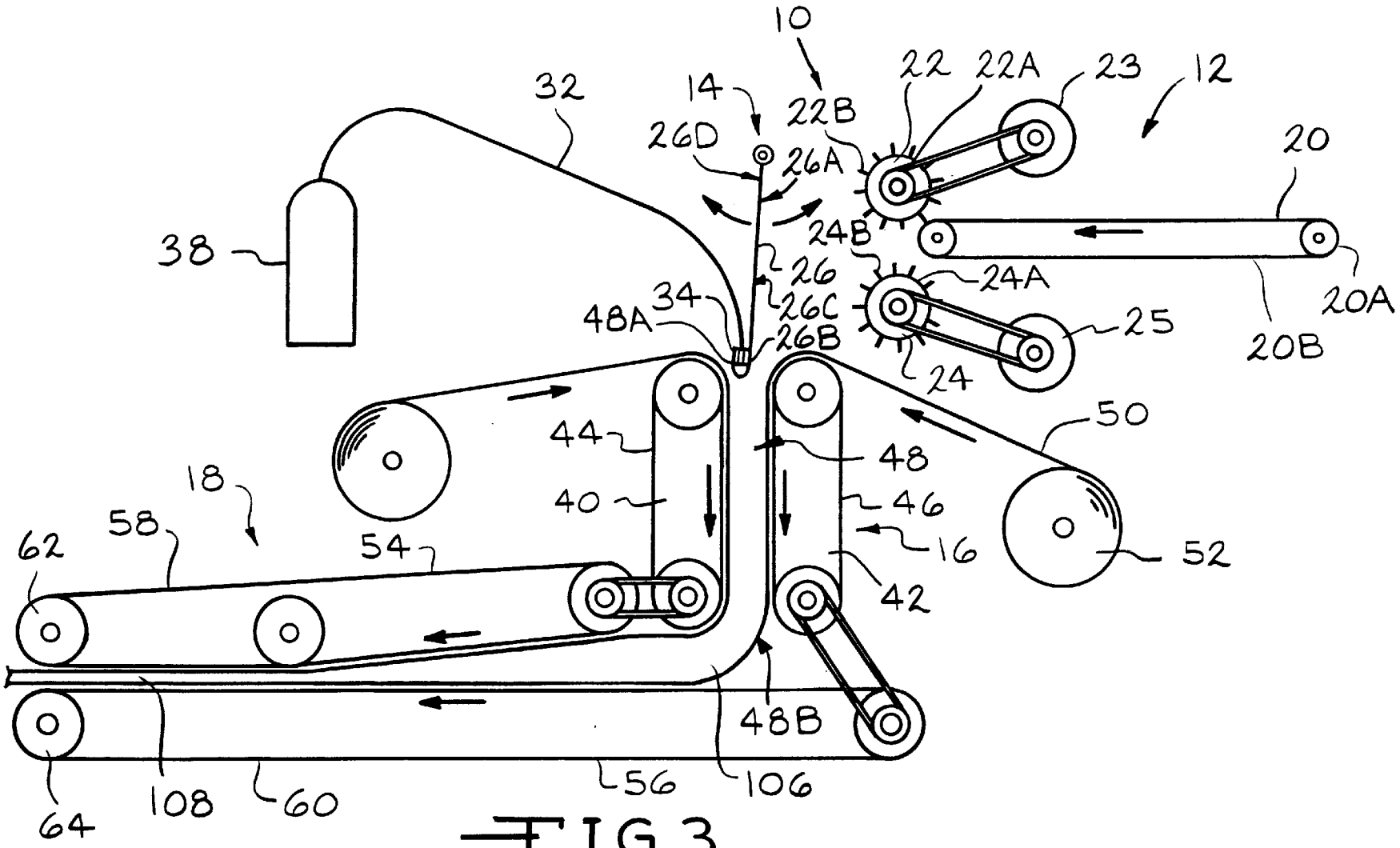
FIG. 3 is a rear schematic view of the system 10 showing the spike wheel drive motors 23 and 25.

FIG. 1 shows the system 10 of the present invention. The system 10 includes a feed zone 12, a unilayering zone 14, a mat reforming zone 16 and a compaction zone 18. The system 10 is mounted on a structural frame 11 which holds the various mechanisms in proper relation with one another. The feed zone 12 allows for adjusting the amount or mass of incoming particles 102 so that the prescribed amount of particles 102 are uniformly advanced to the spike wheels 22 and 24 for precise inclusion in the composite material 108. The preformed feed mat 100 is composed of the material or materials to be used to construct the final composite materials 108. (FIG. 2) The preformed feed mat 100 is composed such as to include the exact amount of particles 102 required for the particular composite material 108 to be produced. The use of the preformed feed mat 100 allows for more closely monitoring the flow of incoming particles 102 into the system 10 and allows for metering the particles 102 uniformly onto the lower spike wheel or impeller 24 (to be discussed in detail hereinafter). The feed zone 12 includes a feed tray or feed conveyor 20, an upper spike wheel 22 and a lower spike wheel 24. The feed conveyor 20 is preferably a rough surface belt driven by a variable speed motor (not shown). The feed conveyor 20 is preferably horizontal with the ground surface, however, the feed conveyor 20 may be inclined to allow feeding from the ground level. The feed conveyor 20 moves the preformed feed mat 100 toward the upper spike wheel 22. The upper spike wheel 22 is preferably a drum 22A having a plurality of nail-like projections 22B extending outward from the surface of the drum 22A (FIG. 2). The projections 22B are preferably of such a length as to engage the oncoming edge of the preformed feed mat 100 and strip off the prescribed amount of particles 102. In the preferred embodiment, the nail-like projections 22B have a length of about 0.5 inches (0.3 cm) which will accommodate most fibrous materials. Although the above means is preferred, any well known means of delivering particles 102 uniformly onto the lower spike wheel 24 is acceptable. One example of a system for forming the feed mat 100 is a mechanism which is marketed under the trademark THE RANDO PREMATTER™ by Rando Corp, Macedon, N.Y. The particles 102 stripped from the preformed mat 100 are passed on to the lower spike wheel 24. The lower spike wheel 24 is mounted directly below the upper spike wheel 22 or slightly rearward of the upper spike wheel 22 so as to ensure all the particles 102 are caught by the lower spike wheel 24. The lower spike wheel 24 or impeller is preferably similar to the upper spike wheel 22 and has a drum 24A with a plurality of nail-like projections 24B. The primary purpose of the lower spike wheel 24 is to propel the particles 102 removed from the preformed feed mat 100 by the upper spike wheel 22 into the unilayering zone 14. The upper and lower spike wheels 22 and 24 are preferably independently driven by spike wheel drive motors 23 and 25, so that the speed of the spike wheels can be differentially changed for different fiber loadings (FIG. 3). In the present embodiment, the upper and lower spike wheels 22 and 24 rotate at the same speed in opposite directions. The lower spike wheel 24 rotates in the direction such as to impel the particles 102 toward and into contact with the oscillating shield 26 of the unilayering zone 14 (to be described in detail hereinafter).

The unilayering zone 14 includes an oscillating shield or plate 26 and a spray nozzle system 32 (FIG. 1). The unilayering zone 14 has the function of reducing the feed material or particles 102 essentially to a unilayer or single layer in preparation for receiving binder 104 and being deposited on the forming edge of the reconstituted mat 106. The oscillating or reciprocating shield 26 has a top end 26A and a lower end 26B with a front surface 26C and a back surface 26D extending therebetween. The shield 26 is mounted such that the shield 26 is perpendicular to the feed conveyor 20 and the front surface 26C of the shield 26 is adjacent the spike wheels 22 and 24. The shield 26 is pivotably mounted at the top end 26A such as to be able to oscillate or reciprocate horizontally toward and away from the spike wheels 22 and 24 (FIG. 2). Alternatively, the shield 26 is mounted on a track (not shown) so that while oscillating, it always remains in vertical aspect. The shield 26 is oscillated by a motor 28 which is eccentrically connected to the back surface 26D of the shield 26 by a rod 30 (FIG. 1). In the first embodiment, the shield 26 is positioned a distance of 12 inches (31 cm) from the outer circumference of the spike wheels 22 and 24 when at rest at the midpoint of the thickness of the reformed mat 106. The shield 26 oscillates at a speed that depends on the rate of feed of the particulate material 102, laying down approximately 0.5 to 1 inch (1.3 to 2.5 cm) of mat per cycle and falling in a range of 30 to 120 cpm. The shield 26 oscillates a total distance equal to the width of the tunnel conveyor 48 of the mat reforming zone 16 which is equal to the thickness of the reformed mat 106. The top end 26A of the shield 26 is preferably at least positioned as high as the upper spike wheel 22. The shield 26 is of such a length as to completely extend the distance between the upper and lower spike wheels 22 and 24 and beyond the bottom of the outer circumference of the lower spike wheel 24 (FIG. 1). Thus, any particles 102 that are projected by the lower spike wheel 24 are impacted on the front surface 26C of the shield 26. The shield 26 is enclosed within a sheet metal enclosure (not shown) to prevent particles 102 from escaping sideways. The width of the shield 26 is at least equal to the width of the upper and lower spike wheels 22 and 24, which is preferably equal to the width of the preformed feed mat 100. The shield 26 can have a variety of configurations. The configuration of the front surface 26C of the shield 26 has a bearing on the orientation of the particles 102 in the reformed mat 106. For example, a flat front surface 26C, produces a random orientation in the plane of the shield 26. This orientation persists to a large degree in the reconstituted mat 106. A curved shield 26, which concaves horizontally toward the spike wheels 22 and 24, tends to orient particles 102 parallel to the trailing edge of the reconstituted mat 106. A vertically fluted shield oscillating both face-wise and edge-wise tends to orient particles predominately in the travel direction of the mat. The feed zone 12 and unilayering zone 14 convert the preformed feed mat 100 into a uniform layer of particles 102.

Figure 4:
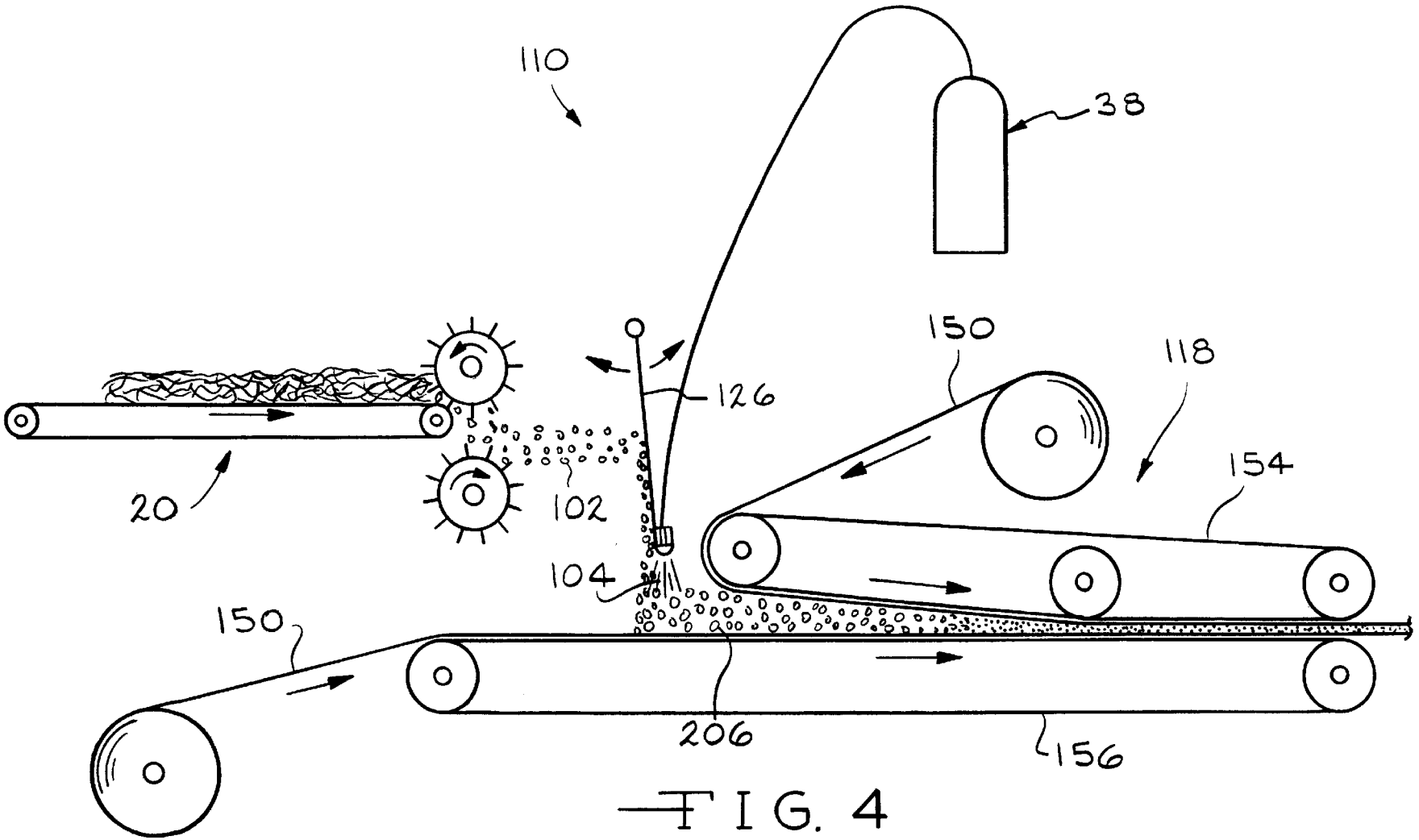
FIG. 4 is a schematic view of a second embodiment of the system 110.

The spray nozzle system 32 for dispensing the binder 104 is preferably mounted on the back surface 26D of the shield 26 adjacent the lower end 26B (FIG. 1). The spray nozzle system 32 preferably includes a series of spray nozzles 34 connected by flexible tubing 36 to a binder supply 38 (FIGS. 2 and 4). The spray nozzles 34 are preferably positioned such that the tips of the spray nozzles 34 are even with the lower edge of the shield 26 such as to allow the spray nozzles 34 to spray the binder 104 on the particles 102 as the particles 102 move past the lower end 26B of the shield 26 and engage the trailing edge of the reformed mat 106 at the entrance of the tunnel conveyor 48 of the mat reforming zone 16. In the first embodiment, three spray nozzles 34 are spaced apart along the lower end 26B of the shield 26 (FIG. 1). Optimally, the spray nozzles 34 oscillate with the shield 26. Alternately, the spray nozzles 34 are separate from the shield 26 and do not oscillate with the shield 26. The binder 104 can be of liquid or powder form and can be of a variety of types such as those listed above for the consolidation of fibrous strands.

Figure 7:
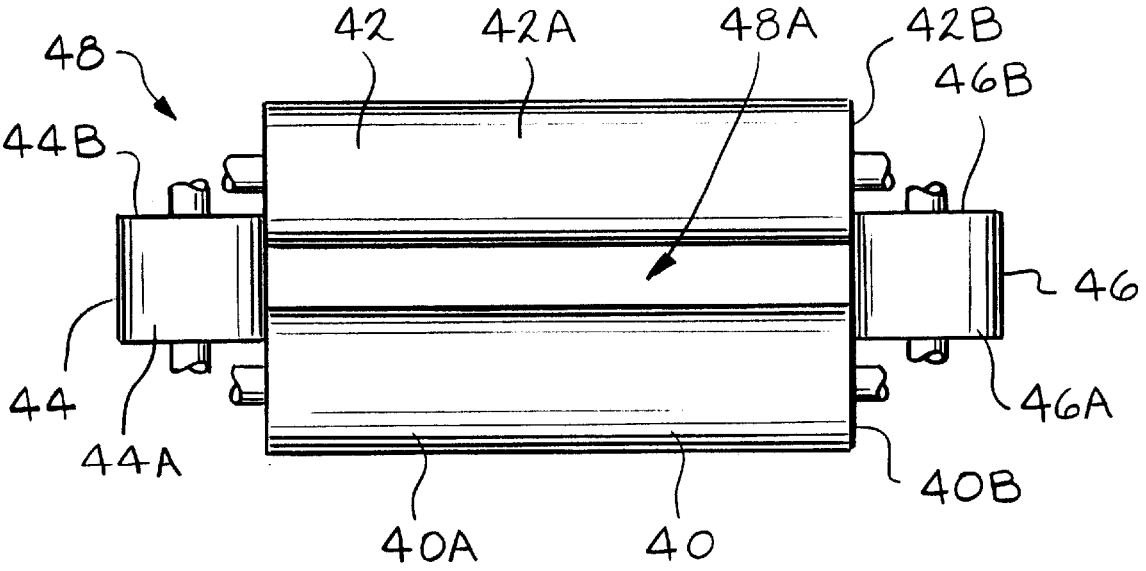
FIG. 7 is a top view of the tunnel conveyor 48 showing the front and back conveyors 40 and 42 and the side conveyors 44 and 46.

In the tunnel conveyor 48 of the mat reforming zone 16, the layer of particles 102 with the binder 104 are reformed into a mat 106. The mat reforming zone 16 includes a pair of vertically spaced apart front and back conveyors 40 and 42 and a pair of vertically spaced apart side conveyors 44 and 46. The side conveyors 44 and 46 are perpendicular to the front and back conveyors 40 and 42 and are positioned on each side of the front and back conveyors 40 and 42. The conveyors 40, 42, 44 and 46 are preferably similar and are all comprised of a belt 40A, 42A, 44A and 46A mounted around rollers 40B, 42B, 44B, and 46B. The belts 40A, 42A, 44A and 46A of the conveyors 40, 42, 44 and 46 are arranged in a box-like fashion and form the vertical tunnel conveyor 48. The conveyors 40, 42, 44 and 46 move in unison and in a direction, such that the particles 102 and binder 104 enter the top 48A of the tunnel conveyor 48 and the reformed mat 106 is moved out of the bottom 48B of the tunnel conveyor 48 (FIG. 2). The front and back conveyors 40 and 42 define the faces of the mat 106. The side conveyors 44 and 46 define the edges of the mat 106 (FIG. 7). The conveyors 40 and 42, are preferably movable such that the size of the tunnel 48 can be adjusted. Adjusting the size of the tunnel 48 allows for changing the thickness of the reformed mat 106. In the first embodiment, the conveyors 40 and 42 of the mat reforming zone 16 are set to produce a reformed mat 106 having a thickness of 6 inches (15 cm). The front and back conveyors 40 and 42 of the tunnel conveyor 48 are also provided with a layer of release paper, film or overlay and underlay 50. In one embodiment, a release paper and overlay 50 are provided such that the reformed mat 106 only has an overlay 50 on one side and a release paper or film on the other side. The release paper or overlay 50 are continuously fed from rolls 52 mounted adjacent each of the conveyors 40 and 42 (FIGS. 2 and 3). The release paper or overlay 50 are fed from the rolls 52 into the tunnel conveyor 48 at the same rate as the conveyors 40, 42, 44 and 46 are moving. A variety of overlays 50 available in roll form can be accepted into the process such as plastic films, paper, veneer and certain tightly woven fabrics.

Figure 5:
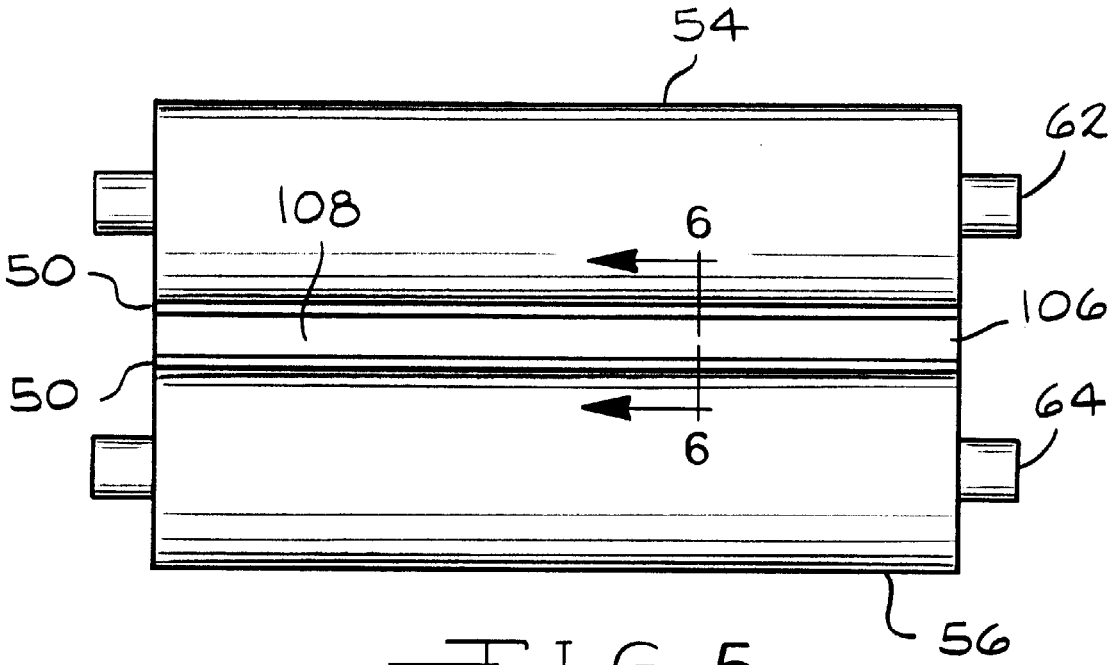
FIG. 5 is an end view of the system 10 of FIG. 1 along line 5—5 showing the final composite material 108.

As the reformed mat 106 exits the tunnel 48 between the conveyors 40, 42, 44 and 46 the reformed mat 106 is turned 90° and enters the compaction zone 18. Alternately, (not shown) the mat continues forward in a straight line and does not turn 90°. The orientation of the compaction zone 18 in relation to the mat reforming zone 16 is largely dependent on the area restrictions for the system 10. Compaction of the reconstituted mat 106 emerging from the reforming zone 16 can be done by any of a variety of conventional means such as continuous caterpillar tread presses, platen presses, molds and bench clamps. The continuous belt system used in the first embodiment was chosen for its low cost and simplicity of operation. Accordingly, in the first embodiment, the compaction zone 18 is comprised of an upper and lower compaction conveyor 54 and 56 (FIGS. 1–4). The conveyors 54 and 56 are comprised of flat belts 58 and 60 spaced between and around rollers 62 and 64. The lower conveyor 56 is longer than the upper conveyor 54 and extends completely under the tunnel conveyor 48 of the mat reforming zone 16. The upper conveyor 54 extends from just past the tunnel conveyor 48 and conveyors 40, 42, 44 and 46 of the mat reforming zone 16 to the end of the system 10. In the first embodiment, the lower conveyor 56 is horizontally level. The upper conveyor 54 however, is inclined part way such that the end of the conveyor 54 adjacent the mat reforming zone 16 is spaced apart a greater distance from the lower conveyor 56 than the portion of the upper conveyor 54 comprising the final third of the length of the compaction zone 18. The final third of the compaction zone 18 is set at the desired final thickness for the composite material 108 (FIG. 5). Thus, the reformed mat 106 is compressed or compacted as the reformed mat 106 moves toward the end of the system 10. The distance between the conveyors 54 and 56 can be adjusted depending upon the thickness of the initially reformed mat 106 and the desired thickness of the resulting composite material 108. The upper and lower conveyors 54 and 56 of the compaction zone 18 are connected to the conveyors 40, 42, 44 and 46 of the mat reforming zone 16 such that the conveyors 40, 42, 44 and 46 of the mat reforming zone 16 and the conveyors 54 and 56 of the compaction zone 18 move at the same speed (FIG. 3). In the initial embodiment all conveyors 40, 42, 44, 46, 54, and 56 run at the same speed. The conveyors 40, 42, 44, 46, 54 and 56 are preferably driven together to assure synchronization of the system 10. Any well known method of driving the conveyors 40, 42, 44, 46, 54 and 56 can be used. The speeds of the conveyors 40, 42, 44, 46, 54 and 56 of the system 10 can be varied depending on the speed of cure of the binder. All of the conveyors 20, 40, 42, 44, 46, 54 and 56 of the system 10 are preferably synchronized to move at the same speed as determined by the speed at which the selected binder cures. For example, using a binder 104 that gels in 30 seconds and hardens to handling strength in about 60 seconds, the speed of the conveyors 40, 42, 44, 46, 54 and 56 of the system 10 is approximately 10 feet per minute.

In another embodiment of the system 110, as shown in FIG. 4, the mat reforming zone is removed such that the particles 102 with the binder 104 cascade or fall directly from the oscillating shield 126 onto the lower conveyor 156 of the compaction zone 118. In this embodiment, a horizontal mat 206 is formed directly on the lower conveyor 156 of the compaction zone 118. In this embodiment, the upper and lower conveyors 154 and 156 of the compaction zone 118 also are provided with the overlays 150 or release paper.

In Use

To optimize use of the system 10 or 110 of the present invention, a preformed feed mat 100 having the same amount of particles 102 as will appear in the final composite material 108 is provided. The preformed feed mat 100 is carried forward at a predetermined speed on the feed conveyor 20 toward the upper spike wheel 22 which progressively strips a predetermined quantity of particles 102 from the leading edge of the preformed mat 100. The upper spike wheel 22 deposits the particles 102 at a controlled rate onto the lower spike wheel 24. The rotating action of the lower spike wheel 24 impinges the particles 102 against the front surface 26C of the oscillating shield or plate 26 in a steady uniform stream. The particles 102 are deposited on the front surface 26C of the shield 26 as a unilayer of particles 102 which moves down the shield 26 due to gravity. The impingement of the particles 102 against the oscillating shield 26 causes a random orientation of the particles 102 in the plane of the shield 26 and creates a uniform deposition of particles 102 across the width and thickness of the shield 26 and ultimately across the width of the edge of the reformed mat 106 and composite material 108. The unilayer of particles 102 moves down the shield 26 and into the entrance of the mat reforming zone 16 and is evenly deposited on the trailing edge of the reformed mat 106 forming in the tunnel conveyor 48 of the mat reforming zone 16. As the particles 102 leave the lower end 26B of the shield 26 the metered binder 104 is applied by the spray nozzles 34 to the particles 102. The oscillation of the spray nozzles 34 with the shield 26 allows for even disbursement of the binder 104 on the particles 102. The particles 102 and binder 104 are deposited into the top 48A of the tunnel conveyor 48 on the trailing edge of the reformed mat 106 in a continuous process. The oscillation of the shield 26 over the receding or trailing edge of the reformed mat 16 in concert with the actions of the spike wheels 22 and 24 produces a reformed mat 106 having a uniform cross section. As the particles 102 with binder 104, in the form of the reformed mat 106, move through the mat reforming zone 16, the overlays 50 are also moving along each side of the reformed mat 106. Since the binder 104 has not yet cured, the binder 104 acts to adhere the overlays 50 on each side of the reformed mat 106.

Figure 6:
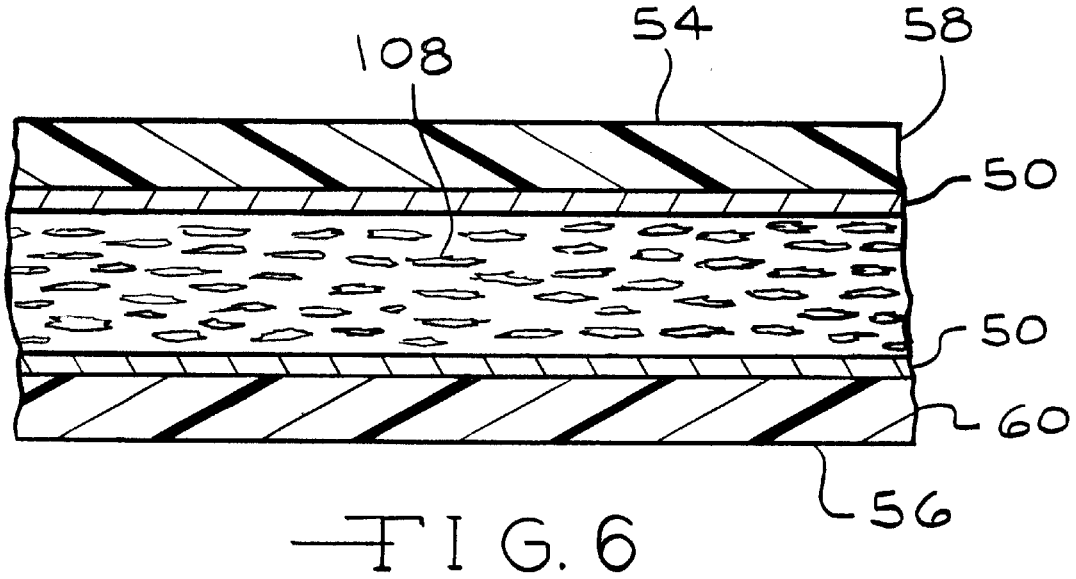
FIG. 6 is a cross-sectional view of FIG. 5 along the line 6—6 showing the composite material 108 as the material 108 exits the compaction zone 18.

At the bottom 48B of the tunnel conveyor 48, the vertical sandwich of release paper or overlays 50 and the reformed mat 106 of binder 104 and particles 102 is made to turn 90 degrees and become horizontal as it progresses through the compaction zone 18 to be reduced to a final thickness and density. The mat 106 of the particles 102 and binder 104 with the release paper or overlays 50 is immediately compacted and consolidated after the mat reforming zone 16 without further manipulation of the particles 102. As the reformed mat 106 advances through the mat reforming zone 16 and the compaction zone 18, the binder 104 advances toward full cure. The close proximity of the mat reforming zone 16 and the compaction zone 18 allows for the use of fast, self-curing binders 104. Once the composite material 108 exits the end of the system, the binder 104 is preferably near full strength. The composite material 108 can then be cut as necessary for a specific use. If a slower setting binder 104 is used, the binder 104 in the composite material 108 is not at full cure when the composite material 108 exits the system 10 (FIG. 6). In this embodiment, the composite material 108 may be formed into another shape such as by molding.

In the alternate system 110 where the tunnel conveyor is removed (FIG. 4), the particles 102 with the binder 104 are deposited directly on the lower conveyor 156 and enter the compaction zone 118. This embodiment would be appropriate for relatively thin materials and for thick materials with lower uniformity requirements.

The system 10 can be used to create a variety of different materials 108 having varying thicknesses and densities and constructed of a variety of different materials. Varying material thickness and density begins by providing the correct amount of material in the form of preformed feed mat 100 to the upper spike wheel 22. The tunnel conveyor 48 of the mat reforming zone 16 is then adjusted to control the thickness of the reformed mat 106. The thickness and density of the final composite material 108 is then completed by raising or lowering the upper conveyor 54 of the compaction zone 18 (FIG. 5). Preferably the zones 12, 14, 16 and 18 are closely coupled to reduce time and allow the use of fast setting binders 104. The system 10 can be used to produce a number of different composite materials 108 using fast-setting binders 104. However, the system 10 can also be used to make mats with binders 104 having slower hardening speeds.

Following are a number of products and procedures that the present systems 10 and 110 are designed to produce. A preformed feed mat 100 of fibrous strands 6 inches (15 cm) thick with a bulk density of 4 pcf is provided on the feed conveyor 20 and moved forward toward the upper spike wheel 22 at a speed of 10 feet per minute. The upper spike wheel 22, turning at 380 rpm, strips fibers or particles 102 from the advancing edge of the mat 100 and deposits them on the lower spike wheel 24. The lower spike wheel 24 is also rotating at 380 rpm. The lower spike wheel 24 flings the particles 102 toward the shield 26 which is oscillating at 60 rpm. Splayed against the shield 26, the particles 102 orient randomly as a unilayer in the plane of the shield 26 and cascade downward toward the lower edge of the shield 26 where they are met with a spray of urethane foam precursor as the binder 104 and deposited uniformly over the width of the receding edge of the mat 106 being reformed between moving conveyors 40 and 42. Release film is fed over the conveyors 40 and 42 to prevent the mat 106 from sticking to the conveyors 40 and 42 and advances with the moving mat 106. Dwell time in the reforming zone 16 is 12 seconds during which time foam expands its way throughout the interstices between the particles 102, but remains pliable. The foam-filled reformed mat 106 of fibrous strands or particles 102 is then horizontalized to be compacted in the compaction zone 18 to a 2 inch (5 cm) thickness and 12.5 pcf density during its 48-second travel through the compaction zone 18. The final composite material 108 is firmly rigid and has sound-absorbing properties. With the same composition and compaction, a tightly woven fabric as the overlay 50 can be introduced instead of the release film and the fabric becomes integrated as part of the emerging panel 108. With the same composition and with compaction to 1 inch (2.5 cm) the resulting board 108 would have a density of 25 pcf, a modulus of rupture of 2400 psi, and an internal bond strength of 175 psi. With the same composition and compaction as the previous example, a high density fiber overlay and underlay can be fed in and emerge as an integral panel 108 with smooth hard surfaces and a lightweight core.

In a similar fashion and given the wide choice of binders 104 coupled with different compositions, overlays 50 and consolidating options, a large variety of different composite products 108 can be produced by the present invention. Representative examples of wood/foam composites include: 4 inch (10 cm) thick panel faced with plywood or OSB on one side for building; 2 inch (5 cm) thick panel of 12 pounds per cubic foot density faced on both sides with fabric for use in office dividers; 1–1.5 inch (2.5–3.8 cm) thick molded corestock for panel doors; 1 inch (2.5 cm) thick panel overlaid on both sides with high density decorative fiber sheet for reduced-weight desk top or other work surfaces post-pressed to 30 pcf density; 0.5–0.75 inch (1.3–1.91 cm) thick panel post pressed to 30 pcf density faced with veneer and edged for use in cabinetry; and, 0.125–0.25 inch (0.318–0.64 cm) thick panel faced with kraft paper or plastic film for boxes or faced on one side with fabric for automobile interiors. These products 108 can be made with fire-resistant foams and would have no formaldehyde release problems.

Many of the above materials can be corrugated or otherwise post-formed into various shapes using rolls, conventional molds or clam presses.

The method of the present invention takes advantage of fast, room-temperature-setting binders. Hence, the binder 104 is added as close as possible to the beginning of the compaction zone 18, either by spraying directly onto the reformed mat 106 or during formation of the mat 106. In molding processes, the mat 106 can either be placed in the mold and binder 104 added, or the binder-treated mat 106 can be taken from the belt press or mat-forming zone 16 "green" and transferred to a mold or flat press for shaping or densifying and final curing.

It is intended that the foregoing description be only illustrative of the present invention that many refinements and other embodiments can be derived therefore by those knowledgeable in the field and that the present invention be limited only by the hereinafter appended claims.

We claim:

1. In a system for forming a composite material of discontinuous particles bound with a binder by introducing the binder onto the particles, the improvement which comprises:

(a) a vertically oriented plate with opposed first and second ends and having opposed faces which is pivoted at the first end and mounted on a frame;

(b) a supply means for the binder having an opening and mounted adjacent the second end of the plate so as to feed the binder to the particles;

(c) a moving means mounted on the frame means for oscillating the plate;

(d) a feed means for impacting the particles against one of the faces of the plate so that the particles flow toward the second end of the plate as a layer which is then provided with the binder from the supply means; and (e) a conveyor means for forming the layer of particles with the binder into a mat, for conveying the mat away from the second end of the plate and for forming the composite material.

2. The system of claim 1 wherein a compaction means for consolidating the particles with the binder is closely coupled with the conveyor means.

3. The system of claim 1 wherein the feed means includes a first rotating drum with projections which propel the particles against one of the faces of the plate.

4. The system of claim 3 wherein the feed means includes a conveyor and a second drum with projections which is mounted above the first drum and wherein the second drum extracts the particles from the premat feed by the conveyor and feeds the particles to the first drum.

5. The system of claim 2 wherein the compaction means comprises spaced apart converging belts which compact the particles and the binder.

6. The system of claim 1 wherein the supply means for the binder is mounted on the second end of the plate.

7. The system of claim 1 wherein the conveyor means has vertically oriented belts spaced apart, positioned such as to form a space having four sides to form the mat and move the mat away from the second end of the plate.

8. The system of claim 7 wherein at least one of the belts of the conveyor means carries an overlay which is applied on a surface of the mat.

9. The system of claim 8 wherein as the mat of particles and binder moves through the conveyor means, the overlay is adhered to the surface of the mat by the binder.

10. The system of claim 1 wherein the supply means for the binder oscillates with the plate.

11. The system of claim 1 wherein the conveyor means is aligned and parallel with the plate.

12. The system of claim 1 wherein the conveyor means is perpendicular to a plane of the plate.

13. A method for forming a composite material of discontinuous particles bound with a binder by introducing a binder onto the particles, which comprises the steps of:

(a) providing a system having a vertically oriented plate with opposed first and second ends and opposed faces which is pivotably mounted at the first end on a frame; supply means for the binder having an opening and mounted adjacent the second end of the plate; oscillating means mounted on the frame for moving the plate; feed means for impacting the particles against one of the faces of the plate; and conveyor means for forming the layer of particles with the binder into a mat, for conveying the layer of the particles with the binder away from the second end of the plate and for forming the composite material;

(b) introducing the particles into the feed means;

(c) propelling the particles from the feed means toward the plate;

(d) impinging the particles on one face of the plate;

(e) moving the plate so that the particles flow toward the second end of the plate as a layer and are distributed evenly across the mat;

(f) applying from the opening in the supply means, the binder to the layer of particles adjacent the second end of the plate; and (g) moving the layer with the binder through the conveyor means.

14. The method of claim 13 wherein the particles and binder are formed into a mat in the conveyor means.

15. The method of claim 14 wherein a compaction means is provided in close proximity to the conveyor means and wherein as the mat moves through the compaction means, the mat is reduced to a predetermined thickness.

16. The method of claim 15 wherein as the mat moves through the conveyor means and the compaction means, the binder advances towards a hardened state, consolidating the particles in the composite material.

17. The method of claim 13 wherein as the mat moves along the conveyor means, an overlay is applied to surfaces of the mat.

18. The method of claim 13 wherein the supply means oscillates with the plate to evenly apply the binder on the particles.

* * * * *